US009885007B2

(12) United States Patent
Falk et al.

(10) Patent No.: US 9,885,007 B2
(45) Date of Patent: Feb. 6, 2018

(54) WAX FORMS WITH PERMANENT HARDWARE

(71) Applicants: Sue Falk, Westlake Village, CA (US); Rebecca Borg, Newbury Park, CA (US); Rony Havive, Oak Park, CA (US)

(72) Inventors: Sue Falk, Westlake Village, CA (US); Rebecca Borg, Newbury Park, CA (US); Rony Havive, Oak Park, CA (US)

( * ) Notice: Subject to any disclaimer, the term of this patent is extended or adjusted under 35 U.S.C. 154(b) by 1463 days.

(21) Appl. No.: 13/644,983

(22) Filed: Oct. 4, 2012

(65) Prior Publication Data

US 2014/0099586 A1 Apr. 10, 2014

(51) Int. Cl.
*C11C 5/00* (2006.01)

(52) U.S. Cl.
CPC ..... *C11C 5/008* (2013.01); *C11C 5/00* (2013.01)

(58) Field of Classification Search
CPC ..... C11C 5/008; F23D 3/28
USPC ..... 431/288, 290, 289
See application file for complete search history.

(56) References Cited

U.S. PATENT DOCUMENTS 214,258 A * 4/1879 Maguire ..... C11O 5/008 431/289
768,435 A 8/1904 Ehrhardt
1,067,184 A * 7/1913 Lynch ..... C11C 5/006 431/289
1,551,104 A * 8/1925 Hawley ..... F21V 35/00 156/293
2,300,226 A * 10/1942 Ketchum ..... F21V 35/00 403/312
2,324,723 A * 7/1943 Powers ..... C11C 5/006 403/361
2,463,988 A * 3/1949 Marek ..... F21V 37/00 102/336
2,499,079 A * 2/1950 Steinhilb ..... F21V 35/00 428/16
2,812,653 A * 11/1957 Meunier ..... F21V 37/00 431/291
3,388,960 A * 6/1968 Cangialosi ..... C11C 5/008 431/126
3,741,711 A * 6/1973 Bryant ..... C11C 5/008 431/125

(Continued)

FOREIGN PATENT DOCUMENTS

JP 9063353 3/1997
WO WO 95/24588 9/1995

(Continued)

*Primary Examiner* — Avinash Savani
*Assistant Examiner* — Deepak Deean
(74) *Attorney, Agent, or Firm* — Cislo & Thomas, LLP

(57) ABSTRACT

A wax form, such as a candle, capable of being decorated or adorned with ornamentation using hardware embedded inside the wax form so as to be inconspicuous. The hardware comprises a connector that is flush with the perimeter surface of the candle so that ornamentation can be attached to the connector; thereby, allowing the ornamentation hang on the perimeter surface of the wax form. The connector can utilize a variety of fastening systems to connect to the ornamentation, such as a magnet system, a resistance fit system, a screw fit system, and the like.

12 Claims, 5 Drawing Sheets

(56) References Cited

U.S. PATENT DOCUMENTS 3,753,643 A * 8/1973 Golden ..... C11C 5/008 362/810
3,759,478 A 9/1973 Schmitt et al.
3,983,677 A 10/1976 Lundborn
4,225,552 A * 9/1980 Chang ..... C11C 5/008 264/247
4,304,547 A 12/1981 Buzil
4,477,249 A * 10/1984 Ruzek ..... F21S 6/001 431/253
5,078,591 A * 1/1992 Despres ..... F21S 13/00 431/288
5,927,965 A * 7/1999 Pappas ..... C11O 5/006 264/247
6,033,209 A * 3/2000 Shin ..... C11O 5/008 431/253
6,074,199 A * 6/2000 Song ..... C11O 5/006 431/253
6,805,551 B1 * 10/2004 Feuer ..... C11O 5/008 431/288
6,896,511 B2 * 5/2005 Chadha ..... F23D 3/16 431/289
7,086,752 B1 * 8/2006 Feuer ..... C11C 5/006 362/161
7,121,686 B1 * 10/2006 Chu ..... F21S 19/00 362/228
7,144,246 B2 12/2006 Barnstead
7,252,423 B1 * 8/2007 Wang ..... C11O 5/008 362/392
7,293,984 B2 * 11/2007 Ortiz, Jr. ..... F23D 3/16 431/289
7,546,668 B2 6/2009 Strelnieks
7,658,608 B2 * 2/2010 Weathersbee ..... C11O 5/008 264/139
8,348,662 B2 * 1/2013 Decker ..... F23D 3/16 431/125
2001/0031438 A1 * 10/2001 Hannington ..... C11O 5/004 431/288
2006/0147857 A1 * 7/2006 Barnstead ..... C11C 5/004 431/126
2006/0172241 A1 * 8/2006 Hohertz ..... C11C 5/008 431/289
2006/0172242 A1 * 8/2006 Collard ..... F23D 3/16 431/289
2007/0020573 A1 * 1/2007 Furner ..... F21S 19/00 431/289
2007/0134606 A1 6/2007 Lin
2008/0036116 A1 2/2008 Lajole
2008/0076081 A1 * 3/2008 Keiffer ..... C11C 5/006 431/35
2008/0299407 A1 * 12/2008 Amboy ..... B44C 5/04 428/542.2
2009/0104577 A1 4/2009 Campbell et al.
2012/0118317 A1 * 5/2012 Payne ..... A45D 8/00 132/275

FOREIGN PATENT DOCUMENTS

WO WO 2008/034586 3/2008
WO WO 2009/090199 7/2009
WO WO 2011/081936 7/2011

* cited by examiner

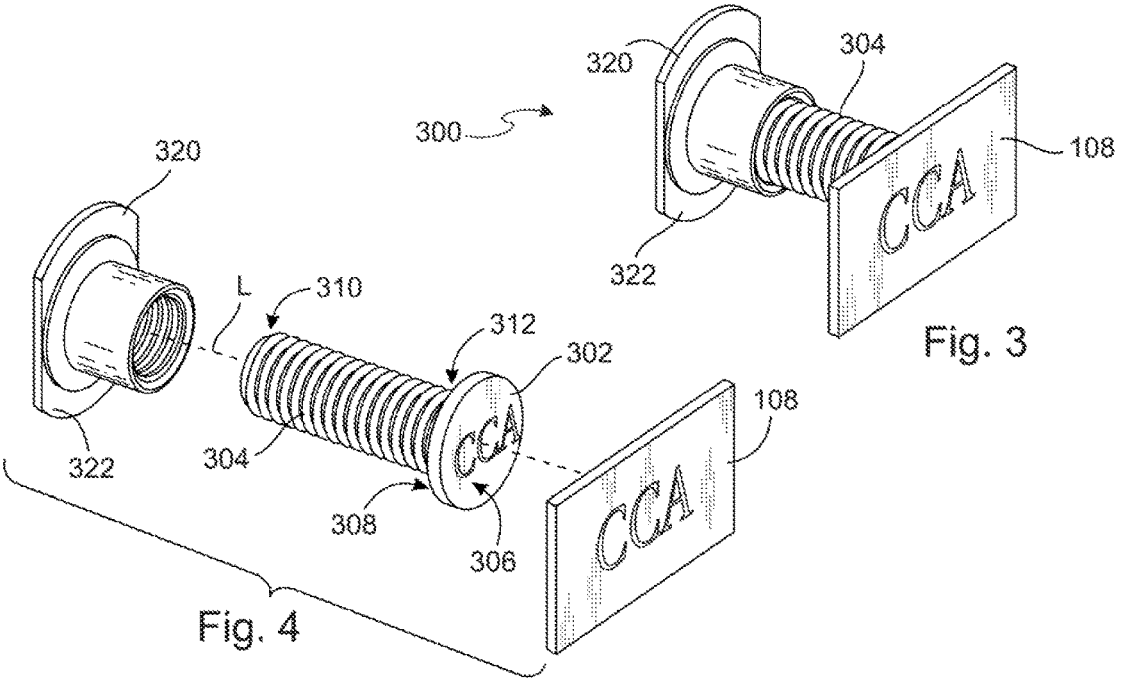
Fig. 3
Fig. 4
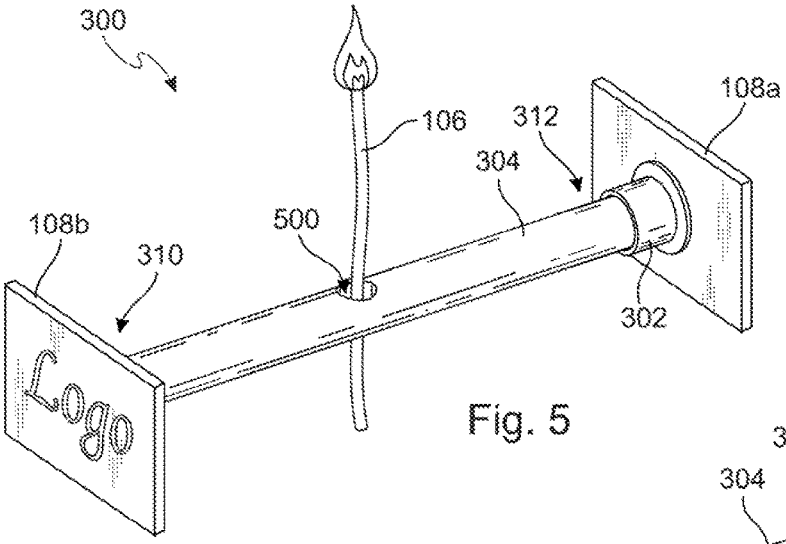
Fig. 5
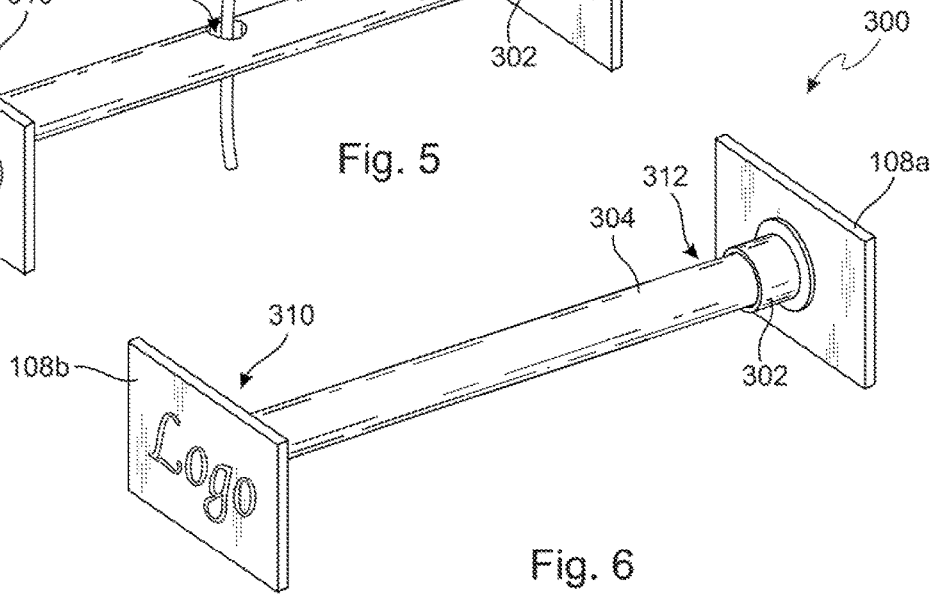
Fig. 6

WAX FORMS WITH PERMANENT HARDWARE

CROSS-REFERENCE TO RELATED APPLICATION

This patent application claims the benefit of U.S. Provisional Patent Application No. 61/628,169, entitled "Method of making wax forms with permanent hardware for Attaching Ornamentation," filed Oct. 24, 2011, which application is incorporated in its entirety here by this reference.

BACKGROUND OF THE INVENTION

Technical Field

This invention relates to making of wax forms, including but not limited to candles, with permanent hardware.

Background Art

Currently, there are candles and wax forms that have ornamentation affixed to their sides, most often with adhesives or by tying some type of material around the candle, such as string or raffia, or pinned into the wax. Some ornaments are molded into candles and wax forms, but these are permanently embedded, and have no provisions by which to attach other ornamentation. Thus, there is a need for a method and apparatus for embedding permanent hardware into the surface of a wax form or candle, wherein the hardware acts as an ornament itself, and may further serve as an attachment device for other ornamentation.

BRIEF SUMMARY OF INVENTION

The present invention is directed to wax forms, including candles, and hardware embedded therein. The hardware allows wax forms and candles to be adorned with ornamentation. To that effect, a connector portion of the hardware may be flush with the outer surface of the wax form or candle. The connector comprises a fastener to attach to the ornamentation. The ornamentation has a reciprocal fastener to attach to the connector.

In some embodiments, the hardware may have a stabilizer to facilitate securing the hardware in the wax form or candle. In some embodiments, multiple hardware may be utilized to hold multiple ornamentation. In some embodiments, the hardware may have multiple connectors, each connector flush with an outer surface region of the wax form for candle.

The hardware can be used in wax forms or candles of any shapes and sizes to provide a discreet way of adorning the wax forms or candles with ornamentation.

BRIEF DESCRIPTION OF THE DRAWINGS

FIG. 3 is an embodiment of a hardware of the present invention.

FIG. 4 is an exploded view of the hardware shown in FIG. 1.

FIG. 5 is a perspective view of another embodiment of a hardware of the present invention.

FIG. 6 is a perspective view of another embodiment of a hardware of the present invention.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 14:
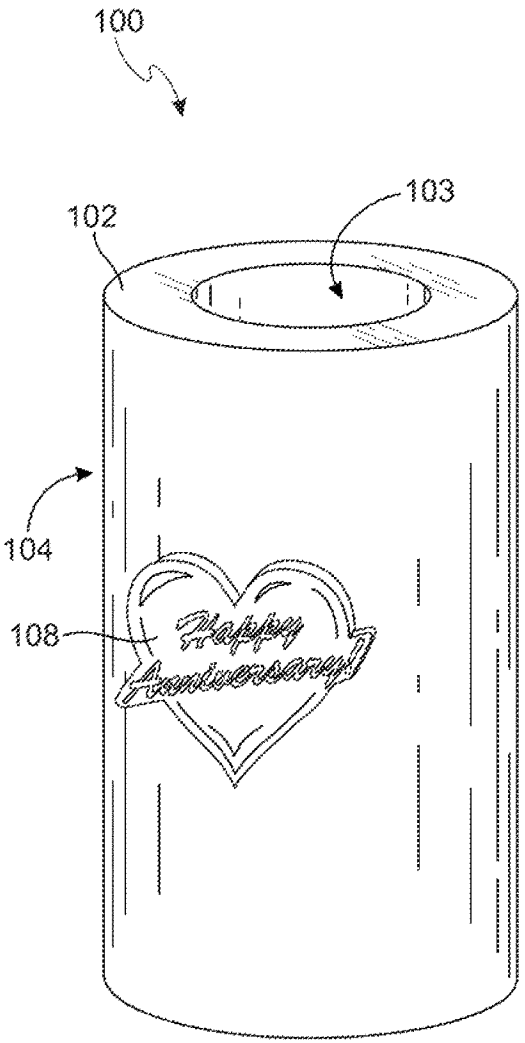
FIG. 14 is a perspective view of a hurricane embodiment of the invention with an ornamentation attached.

The present invention is directed towards a decorable wax form or candle 100. In this description, decorable means capable of being decorated or adorned, for example, with ornamentation, including two or three dimensional shapes, letters, or numbers, music boxes, broaches, and other articles or accessories used to beautify an object. The decorable candle 100 typically comprises a wax core 102 having an outer surface 104, an optional wick 106 embedded in the core, and a hardware 300 permanently embedded in the core 102. Alternatively, the decorable wax form or candle 100 may be in the form of a hurricane, which comprises a wax shell with at least one open end and a hollow interior, as shown in FIG. 14. A hurricane may a variety of shapes, including but not limited to round (see FIG. 14), square, rectangular, polygonal, oval, etc. (not shown). A hurricane is typically used to contain another illumination source, such as a candle, an LED lamp, or other illumination source that can highlight the design of the wax shell. The "core" 102 in a hurricane refers to the wax between the outer surface 104 and the interior surface 103, which interior surface 103 defines the hollow interior, as depicted in FIG. 14.

Figure 8:
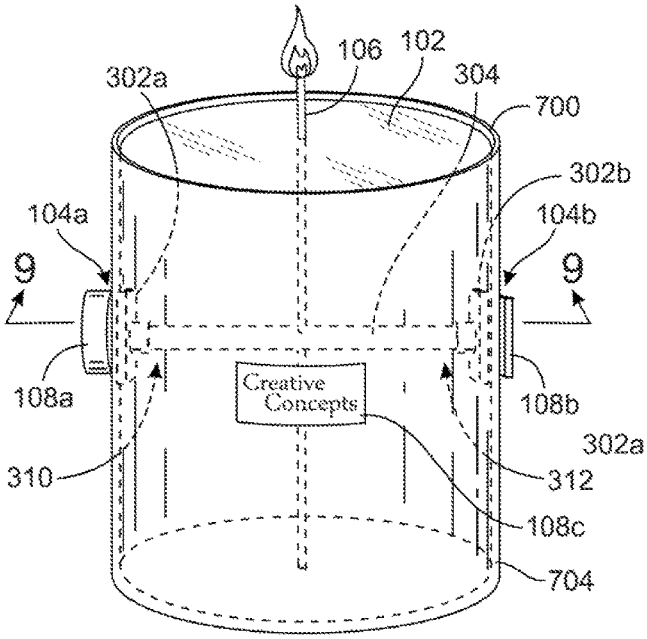
FIG. 8 is another embodiment of a mold filled with wax with the hardware in place.
Figure 9:
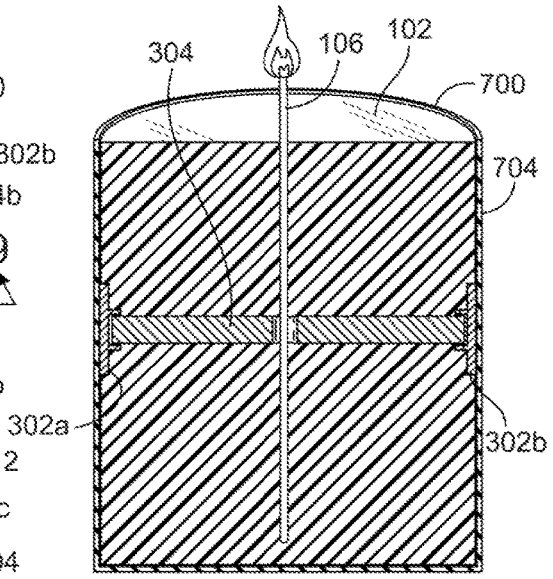
FIG. 9 is a cross-section through line 9-9 of FIG. 8.

The hardware 300 provides a means for adorning the candle with ornamentation 108. In general, the hardware 300 can be any device capable of allowing ornamentation 108 to be attached to it while the hardware 300 is embedded inside the wax core 102. As such, the hardware 300 has a connector portion 302 and an anchor portion 304 as shown in FIGS. 3-6. The connector portion 302 is configured to attach to the ornamentation 108. The anchor 304 is configured to embed inside the wax core 102 so as to hold the ornamentation 108 in place on the wax core 102 as shown in FIGS. 8 and 9.

Figure 11:
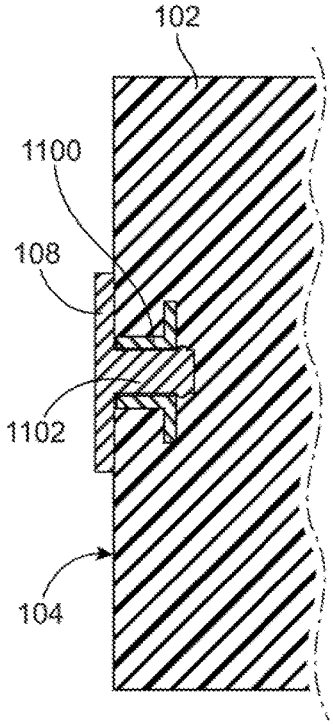
FIG. 11 is a close-up of a cross-section of an embodiment of the hardware in place with an ornamentation attached.
Figure 12:
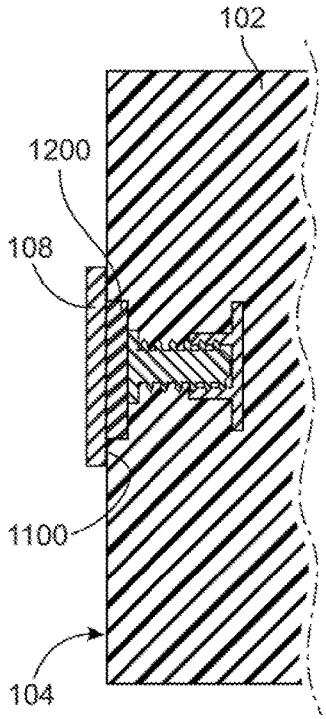
FIG. 12 is a close-up of a cross section of another embodiment of the hardware in place with an ornamentation attached.
Figure 13:
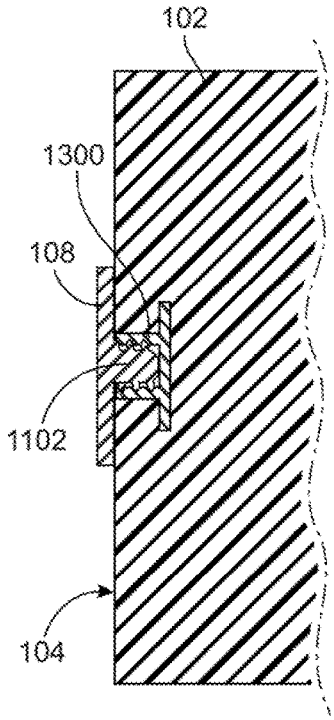
FIG. 13 is a close-up of a cross-section of another embodiment of the hardware in place with an ornamentation attached.

The connector 302 has a first side 306 and a second side 308 opposite the first side 306. The first side 306 is generally a surface that can be positioned flush with the outer surface 104 of the candle. The first side 306 also comprises a fastener or fastening mechanism. The fastener may be a resistance fit system 1100 as shown in FIG. 11, an adhering system 1200 as shown in FIG. 12, a screw system 1300 as shown in FIG. 13 or other types of fastening systems, including but not limited to, a hook-n-loop system, a button system, or any other type of reversible fastening system, and any combination thereof, preferably with quick-release capabilities, meaning the fastening system can be fastened and unfastened quickly without the need of any additional tools as in the examples above. The second side 308 is configured to connect to the anchor 304.

In the resistance fit system shown in FIG. 11, the resistance fit fastener 1100 has a hole aligned flush against the outer surface 104 of the candle through the connector 1102 through which a reciprocal connector of the ornamentation 108 can be inserted. The reciprocal connector 1102 may have substantially the same dimensions as the hole of the resistance fit fastener 1100 so as to create a tight resistance fit. In the screw system as shown in FIG. 13, the reciprocal connector 1102 and the hole may be threaded so that the reciprocal connector 1102 can be screwed into the hole instead of relying on resistance fit. In the adhering system shown in FIG. 12, the ornamentation 108 and adhering fastener have mating surfaces so as to stick together.

In the preferred embodiment, the anchor 304 is an elongated structure having a first end 310 and a second end 312 opposite the first end 310, the elongated structure defining a longitudinal axis L from the first end 310 to the second end 312. The second end 312 connects to the second side 308 of the connector 302 by various means. For example, the anchor 304 may be integrally formed with the connector 302. In some embodiments, the anchor 304 may be fastened to the connector 302, for example, by welding or by screwing, clipping, adhering, and the like with an appropriate fastening system. With the anchor 304 embedded within the wax core 102, the connector 302 is provided with the proper stability to maintain the ornamentation 108 on the wax candle.

In some embodiments, to counter any force on the anchor 304 created by the ornamentation 108, the hardware 300 may also comprise a stabilizer 320 at the first end 310 of the anchor 304. The stabilizer 320 defines a surface 322 that is non-parallel to the longitudinal axis L of the anchor 304. Preferably, the stabilizer 320 defines a surface 322 that is generally perpendicular to the longitudinal axis L of the anchor 304. The stabilizer 320 may be removably or irremovably connected to the anchor 304. Any fastening system described above connecting the anchor 304 to the connector 302 may be used here as well. Preferably, the fastening system is reversible. This permits interchangeability of an anchor 304 with different stabilizers 320. For example, for a large candle with a heavy ornament 108, the stabilizer 320 should have a large surface area to keep the anchor 304 in place when the ornament 108 is attached. For smaller candles, space in the candle may not be available so a stabilizer 320 with a smaller surface area would be used. In other embodiments, the anchor 304, stabilizer 320, and connector 302 may all be a single unit, which may be cast, stamped, or otherwise formed as a unitary piece. The hardware 300 may be of any size or shape, but in a preferred embodiment it is approximately ½ inch in length, sufficiently long to be permanently embedded in the wax form, but short enough not to interfere with the burning of any wick 106.

Figure 1:
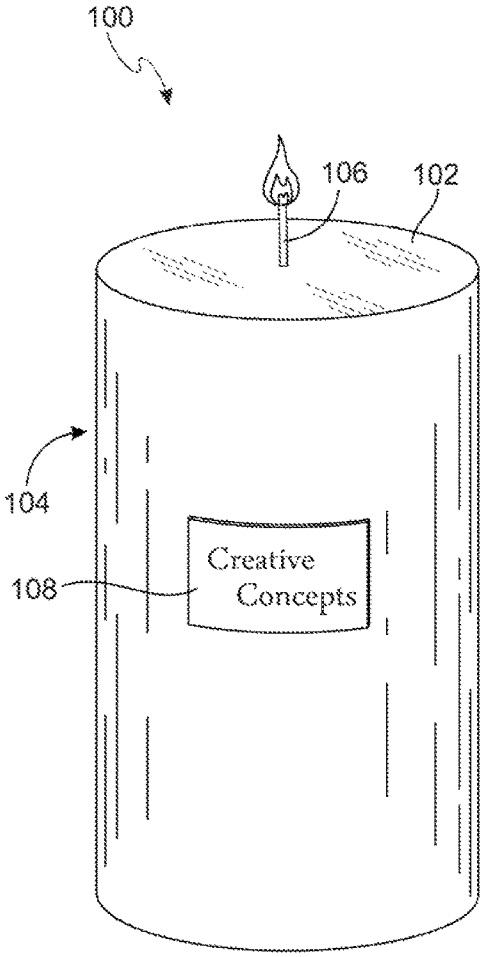
FIG. 1 is a perspective view of an embodiment of the present invention.
Figure 2:
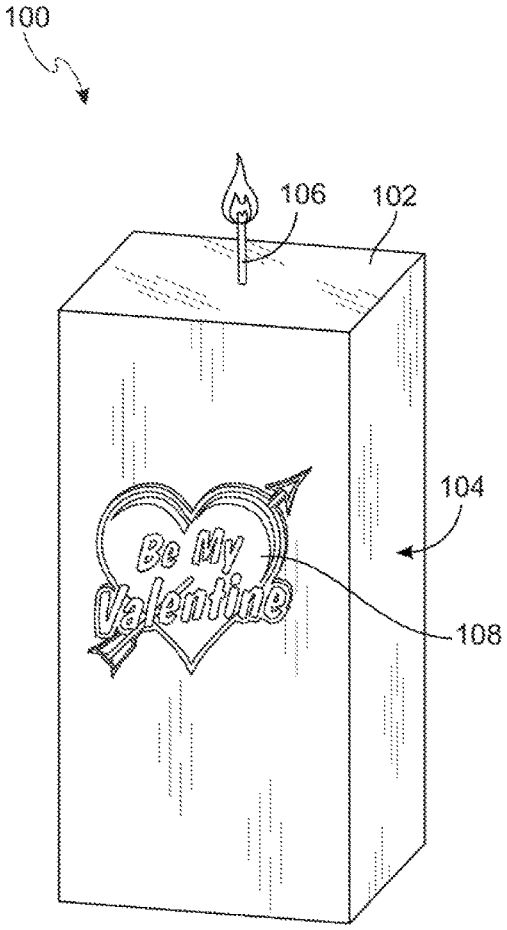
FIG. 2 is a perspective view of another embodiment of the present invention.
Figure 7:
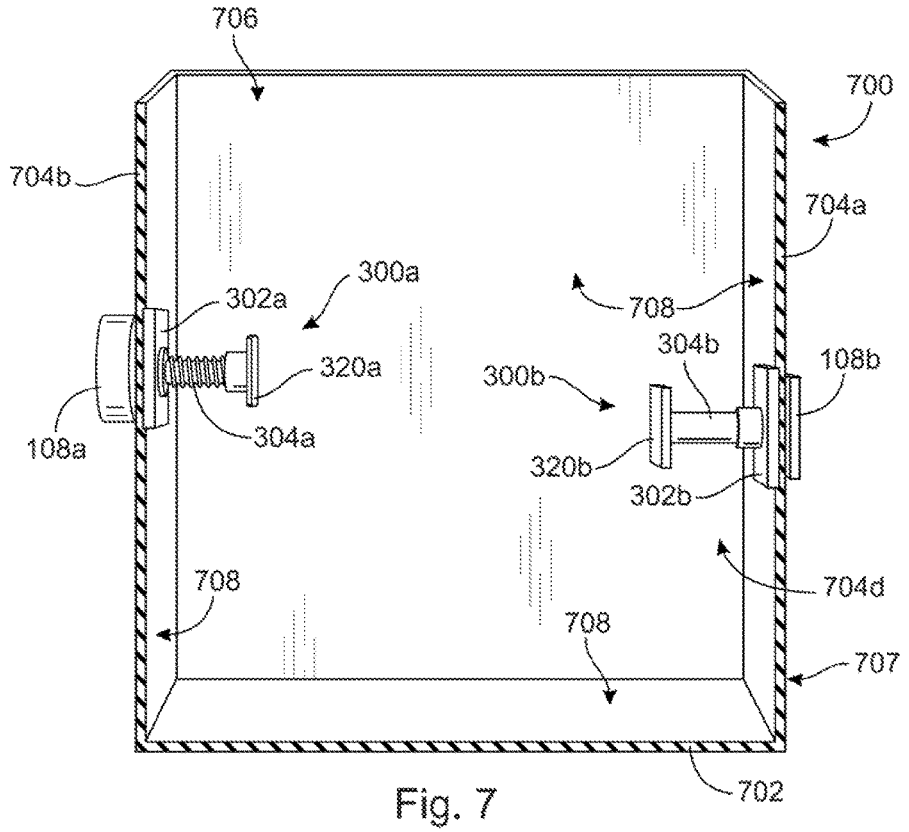
FIG. 7 is a side view of a cross section of an embodiment of a mold with the hardware in place.

In some embodiments, the decorable candle 100 may be provided with a plurality of hardware 300*a*, 300*b* each having its own connector 302*a*, 302*b*, anchor 304*a*, 304*b*, and stabilizer 320*a*, 320*b* as shown in FIG. 7. This would allow a single candle to be decorated with a plurality of ornamentations 108*a*, 108*b*, 108*c* (shown where the ornamentation would be located after removal of the mold).

Figure 10:
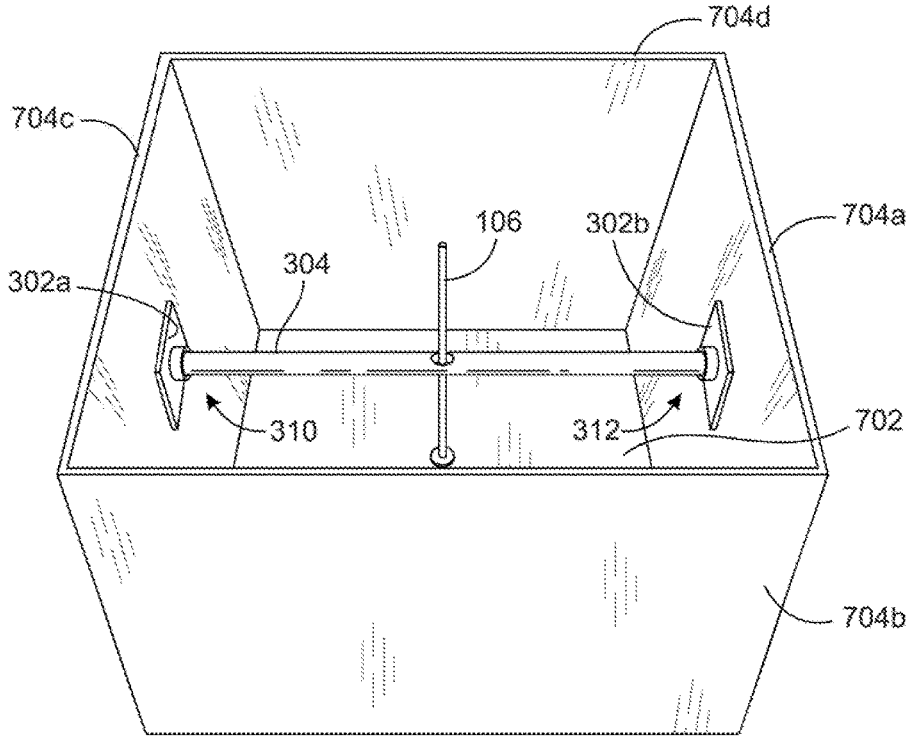
FIG. 10 is a perspective view from the top of another embodiment of a mold with the hardware in place, prior to filling with wax.

In some embodiments, the length of the anchor 304 may be shorter than the thickness or diameter of the wax core 102. In some embodiments, the length of the anchor 304 may be approximately the thickness of the wax core 102 as shown in FIGS. 8-10. In other words, the first end 310 of the anchor 304 may extend to a first surface region 104*a* of the candle and the second end 312 may extend to a second surface region 104*b* as shown in FIGS. 8-10: For example, for a cylindrical wax core, the length of the anchor 304 may be approximately the diameter of the wax core 102 so that the first end 310 of the anchor 304 and the second end 312 of the anchor 304 are at diametrically opposite ends of the wax core. Each end may comprise its own connector 302*a*, 302*b* with the first connector 302*a* flush with a first surface region 104*a* of the wax core 102 and the second connector 302*b* is flush with the second surface region 104*b* of the wax core 102. In such an embodiment, a stabilizer 320 would not be required as the connectors 302*a*, 302*b* would function as stabilizers for each other.

In some embodiments, the anchor 304 may comprise a hole 500 through which the wick 106 may be inserted as shown in FIGS. 5, 8, 9, and 10. This would be particularly important in embodiments in which the anchor 304 passes through the center of the wax core 102. Although the hole 500 is shown as a hole in a rod in FIGS. 5 and 10, the hole 500 may be an entirely different structure, such as a large ring (not shown). Such a ring may be made of spring material that may assist holding the connectors 302*a*, 302*b*, against the sides of the mold 700.

In some embodiments, the first side 306 of the connector 302 may comprise an ornamental feature, thereby, functioning as the ornamentation 108, such as a company logo, tradename, or other decorative design as shown in FIG. 4. In some embodiments, an ornamentation 108 may be provided that can be connected to the first side 306 of the connector 302. For example, the ornamentation 108 may be two or three-dimensional letters that are removably attachable to the first side 306 of the connector 302. Various other removably attachable ornamentations may be employed, including by not limited to two-dimensional or three-dimensional designs and shapes, music boxes, broaches, etc. In some embodiments, the decorable candle 100 may be provided with a plurality of ornamentations 108*a*, 108*b*, 108*c* each ornamentation removably attachable to the first side 306 of the connector 302 so that each ornamentation is interchangeable with another ornamentation. A single connection 302 may comprise multiple fastening mechanisms so that ornamentation 108*a*, 108*b* having different fastening mechanisms can still be used on a given connector 302. In other words, the connector 302 may be a type of "universal" connector.

To make a decorable candle 100 of the present invention a mold 700 having a bottom 702 attached to at least one side wall 704 defining an open top 706 is provided to create the wax core 102. For example, if a cylindrical wax core is needed, then the mold 700 would have a circular bottom 702 attached to a cylindrical side wall 704 having an open top 706. If a rectangular wax core 102 is made, then the mold 700 would have a rectangular bottom 702 with four sidewalls 704*a*, 704*b*, 704*c*, 704*d*, and an open top 706. In any case, the sidewall(s) 704, 704*a-d* would have an outer surface 707 and an inner surface 708 defining a cavity. The connector 302 of the hardware 300 can be fixed on the inner surface 708 of the mold 700. Liquid wax can then be poured into the mold 700 allowing the liquid wax to solidify into a solid candle or wax form having a perimeter surface 104 defined by the inner surface 708 of the sidewall 704, 704*a-d* of the mold 700, with the hardware 300 embedded within the solid candle and the connector 302, 302*a*, 302*b* flush with the perimeter surface 104 of the candle. The solid candle containing the embedded hardware 300 may be removed from the mold 700. With the connector 302, 302*a*, 302*b* flush with the perimeter surface 104 of the candle, ornamentation 108*a*, 108*b*, 108*c* can now be attached to the connector 302, 302*a*, 302*b*.

Figure 15:
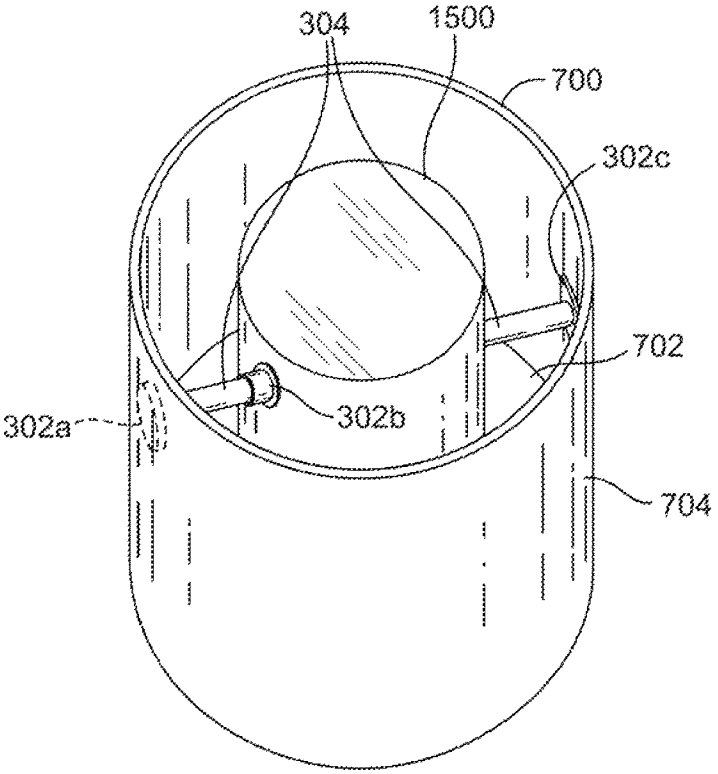
FIG. 15 is a perspective view of an embodiment of a hurricane mold with the hardware in place, prior to filling with wax.

Making a hurricane uses a similar process, but a closed-end insert 1500 may be used inside of the mold 700 to create the cavity of the hollow interior, as depicted in FIG. 15. The insert 1500 is smaller than the mold 700, and may be placed inside the mold 700 prior to pouring the wax. Then the melted wax may be poured between the mold 700 and the insert 1500 to form a hollow interior. Alternatively, an open-end insert may be used, but it may have to be held tightly against the bottom of the mold 700 so that the wax does not get underneath the insert bottom.

Fixing the hardware 300 against the inner walls 708 of the mold 700 can be achieved by a variety of methods. In some embodiments, the fixing step comprises the connector 302 being adhered to the inner surface 708 of the mold 700 with a removable adhesive (not shown) between the connector 302 and the inner surface 708 of the mold 700. The removable adhesive may be pressure sensitive, air cured, heat cured, RF cured, or any other suitable removable adhesive. After the wax is poured into the mold, the removable nature of the adhesive will allow the candle to be removed with the hardware 300 still embedded. Once the candle is removed from the mold 700, the adhesive is then removed.

Alternatively, the fixing step comprises the connector 302 being adhered to the inner surface 708 of the mold 700 with wax (not shown). The wax may be placed between the connector 302 and the inner surface 708 of the mold 700, or it may be placed so that the adhering wax surrounds the connector 302 and adheres to the inner surface 708 of the mold 700 by surrounding the connector 302. During the wax pouring phase, the adhering wax should stay solid long enough for the hardware 300 to stay in place on the inner surface 708 of the mold 700 while the poured wax hardens around it.

When making a hurricane, the fixing step may comprise the first end 310 of the anchor 304 or the stabilizer 320 being adhered to the outer surface of the insert 1500 with a removable adhesive (not shown) between the first end 310 of the anchor 304 or the stabilizer 320, and the outer surface of the insert 1500. In such an embodiment, the finished wax form 100 may have a connector 302 that is flush with the outer surface 104 of the wax form 100, or beneath the outer surface 104. Alternatively, hardware 300 may be physically held in place inside the mold 700 while the insert 1500 is placed into the mold, with the hardware 300 creating a resistance fit between the inner surface 708 of the mold 700 and the outer surface of the insert 1500, as depicted in FIG. 15. Then the wax may be poured between the mold 700 and the insert 1500 to from the hurricane and embed the hardware 300 in the wax shell. In such embodiments, a connector 302 may be located on the inside of the hollow interior 103 in lieu of, or in addition to, a stabilizer 320. Such an interior connector may be utilized in a similar manner as described for the exterior connector 302.

In some embodiments, the fixing step comprises creating a biasing force against the inner surface 708 of the mold 700 with the connector 302.

In some embodiments, the biasing force may be created by inserting the hardware 300 into the mold 700, wherein the hardware 300 extends substantially from one region of the mold to a diametrically opposite region of the mold so as to create a resistance fit between the mold and the hardware. The anchor 304 may be extendable or telescoping so that the anchor 304 can be lengthened until the first and second ends 310, 312 of the anchor 304 abut and press against the sidewall(s) 704 of the mold 700. In some embodiments, the biasing force created by anchor extensions may be achieved by a plurality of anchor extensions that may not necessarily be diametrically opposed, such as a spoke-type configuration with a plurality of anchors projecting radially outwardly from a central hub. For example, a structure similar to the Mercedes-Benz hood ornament, with three "anchors" pressing against the cylindrical sidewall could result in a resistance fit. Such anchors need not be symmetrical, even for two contact points, if appropriately designed. Such anchors could also be on one or more planes relative to the axis of the candle.

In some embodiments, the mold 700 may have cutouts configured in the shape of the connector 302. The connector 302 essentially plugs the hole created by the cutout so as to prevent the liquid wax from leaking out through the hole.

The hardware 300 may be comprised of any suitable material that will withstand the temperatures of melted wax and have sufficient strength to remain permanently attached to the wax form, but in a preferred embodiment the hardware 300 is made of metal. In some embodiments, the hardware 300, or any of its constituent parts (connector portion 302, anchor portion 304, and stabilizer 320), may be made of blended metals, including but not limited to iron, nickel, cobalt, or their alloys. In such an embodiment, ornamentation 108 may be removably attached by using a magnet, such as shown in FIGS. 7 and 12 (with FIG. 7 depicting the placement of the ornamentation 108 after the mold is removed).

All of the above-described methods and apparatus may be used with any wax form, which may or may not have a wick. Such wax forms may include, but are not limited to, candles, electric-powered or oil-powered "candles," sculptures, art forms, wax hurricane, or any other object made from wax.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A decorable wax form, comprising:

a) a wax core having at least one sidewall defining an outer surface; and b) a hardware embedded in the core, the hardware, comprising:

i) a connector having a first side and a second side opposite the first side, the first side positioned flush with the outer surface of the wax form, wherein the first side comprises a fastener facing outward from the wax form, and ii) an anchor having a first end and a second end opposite the first end, the anchor defining a longitudinal axis from the first end to the second end, the second end connected to the second side of the connector, wherein the anchor is embedded in the core, and wherein the first end is connected to a stabilizer, the stabilizer defining a surface that is non-parallel to the longitudinal axis of the anchor, and the stabilizer is removably connected to the anchor; and c) an ornamentation removably attachable to the fastener, wherein the ornamentation attaches via the fastener.

2. The decorable wax form of claim 1, wherein the first side of the connector comprises an ornamental feature.

3. The decorable wax form of claim 1, wherein the ornamentation is attached by a magnet.

4. The decorable wax form of claim 1, further comprising at least one additional ornamentation, each ornamentation removably attachable to the fastener so that each ornamentation is interchangeable with another ornamentation.

5. The decorable wax form of claim 1, wherein the connector comprises at least one additional distinct fastener.

6. The decorable wax form of claim 1, wherein the decorable wax form is a candle.

7. The decorable wax form of claim 1, wherein the fastener comprises a resistance fit system.

8. The decorable wax form of claim 1, wherein the fastener comprises a screw system.

9. The decorable wax form of claim 1, wherein the fastener comprises a hook-n-loop system.

10. The decorable wax form of claim 1, wherein the fastener comprises a button.

11. The decorable wax form of claim 1, wherein the fastener comprises at least one of the following: a magnetic system, a resistance fit system, a screw system, and a hook-n-loop system.

12. The decorable wax form of claim 1, wherein the ornamentation is fastened by a magnet on the fastener or the ornamentation.

* * * * *